US005784731A

United States Patent [19]

Weber

[11] Patent Number: 5,784,731

[45] Date of Patent: Jul. 28, 1998

[54] PNEUMATIC SPRUNG SURFACE BEARING AND ITS USES

[76] Inventor: Erhard Weber, Keântrupstr. 4, D-49082 Osnabrueck, Germany

[21] Appl. No.: 612,831

[22] PCT Filed: Aug. 20, 1994

[86] PCT No.: PCT/EP94/02772

§ 371 Date: Apr. 11, 1996

§ 102(e) Date: Apr. 11, 1996

[87] PCT Pub. No.: WO95/07644

PCT Pub. Date: Mar. 23, 1995

[30] Foreign Application Priority Data

Sep. 15, 1993 [DE] Germany ..... 43 31 240.3

[51] Int. Cl.[6] ..... A47C 23/06

[52] U.S. Cl. ..... 5/238; 5/236.1

[58] Field of Search ..... 267/122, 34; 5/238, 5/236.1; 188/298

[56] References Cited

U.S. PATENT DOCUMENTS

| | | | |
|---|---|---|---|
| 5,038,429 | 8/1991 | Elmalek et al. | 5/238 |
| 5,052,063 | 10/1991 | Elmalek et al. | 5/238 |
| 5,127,114 | 7/1992 | Hörburger | 5/238 |

FOREIGN PATENT DOCUMENTS

| | | | |
|---|---|---|---|
| 2832584 | 2/1980 | Germany | 5/238 |
| 3232123 | 3/1984 | Germany | 5/238 |

*Primary Examiner*—Steven N. Meyers
*Assistant Examiner*—Tuyet-Phuong Pham
*Attorney, Agent, or Firm*—Foley & Lardner

[57] ABSTRACT

A hydrodynamic sprung surface bearing having at least two bearing elements bearing against a tube-shaped container which is filled with a substantially incompressible medium, and against which side walls bear. Surfaces of the bearing elements bearing against the container are, in total, smaller by one order of magnitude than a surface of the container wall. Even for scarcely progressive, low pressure forces, the preferably T-shaped or anchor-shaped bearing elements cause overturning in a negative stroke direction, along with a pronounced change in shape of the container, and positive arching and consequently a very large coarse contour adaptation stroke. Therefore, a positively supporting adaptation stroke of the bearing elements is achieved. Overturning results in two separate chambers which bring about an inherent progressive damping by effectively reducing streaming through of the substantially incompressible medium. The hydrodynamic sprung surface bearing can advantageously be used for underframes of beds, and upholstery for couches and armchairs because of its pressure equilibrium adaptation capability to the body contour in all lying and sitting positions.

12 Claims, 4 Drawing Sheets

PNEUMATIC SPRUNG SURFACE BEARING AND ITS USES

FIELD OF THE INVENTION

The invention relates to a pneumatic sprung surface bearing having the following properties which are critical in terms of the objective:

BACKGROUND OF THE INVENTION

I. By virtue of its rough contour adaptability, it comes to bear even against highly uneven bodies with an only very slightly progressive adaptive-stroke/pressure-force relation.

I'. It possesses inherent, progressively acting damping during the adaptive stroke movement onto the body or during the shift of the latter.

II. An elastic component acting separately from the rough contour adaptation makes it possible to mount these bodies in a sprung manner.

III. It has both a negative and a positive displacement of the bearing element with a total stroke h of at least the non-loaded container height H and of up to ¾ $H_{tot}$ of the total constructional height of the surface bearing.

The pneumatic sprung surface bearing is employed especially advantageously as an underframe for beds, couches or armchairs, where it allows optimum surface contour adaptation and bearing pressure equalizing, slightly sprung mounting in all the lying and sitting positions of the human or animal body. In the main use of the invention, that of a bed underframe or latticework, many mechanical aero- and hydropneumatic sprung individual bearing constructions are known.

(a) Conventional underframes with tension or helical elastic springs, latticeworks primarily with elastic transverse laminated wood battens in rubber element mountings, common rubber band suspension of a plurality of crosslaths, and water beds.

(b) Non-conventional bed underframes which are based on other operating principles, but which pursue a similar objective to that of the surface bearing. A crosslath frame construction, in which the crosslath ends each rest on an individual piston/cylinder arrangement. The individual stroke volumes of the cylinders are connected hydraulically or pneumatically to one another and are provided with overflow ducts (WO 89/01749).

A multichamber construction with counterpressure springs, which functions on the principle of communicating vessels having a pneumatically displaceable concertina and on which individual crosslaths rest via supporting bars (EP 0 481,157).

A concertina construction under individual or double crosslaths which are connected to one another via flow ducts for pressure equalization and for damping. In addition, vertical guidance and positive coupling of the stroke movement of the two crosslath ends are provided, in order to avoid the throwout effect (U.S. Pat. No. 3,210,889).

A feature common to all these constructions is that Replacement sheet (Rule 26) they are very much more complex than the surface bearing, have a markedly lower stroke/constructional-height ratio and achieve the properties I to III individually in part only, but in total not at all.

(c) to (e) describes latticeworks which use individual operating elements of the pneumatic sprung surface bearing in modified form, but which do not have the critical features according to the invention and comply with none of the properties listed in points I to III.

(c) German Offenlegungsschrift 3,232,123 specifies a latticework consisting of side spars in the form of a U-profile, with a compressible tubular body, on which a plurality of crosslaths are directly laid individually and fixed in welded-on pockets and which can spring into indentations in the U-spars. A very similar construction is described in the U.S. Pat. No. 5,038,429, FIG. 1 (see also EP 0,378,469), but here the tubular body is also sub-divided, for each crosslath laid on, into individual "compartments" with overflow ducts (column 6, line 14 f.).

The disadvantage of this construction is that the laths are laid on directly and over a wide area. In the event of rapid alternating load, there is the risk that the tube will be pinched in the indentations and therefore become leaky.

They will function in a truly effective manner from a technical point of view only when the tubular body is "compressible", that is to say when it consists of an expandable material and/or contains a gas charge.

A similar construction with inflexible crosslaths standing on edge in profile on a gas-filled tubular body is described in EP 0,038,155.

A self-supporting tubular construction, if appropriate in a trough of medium height, with the laths being laid on directly in pockets, is described in DE 2,621,803 and, advantageously from a technical point of view, is filled with a compressible medium. An aero bed consists of two air-filled, self-supporting longitudinal tubes, on which crosslaths rest.

(d) U.S. Pat. No. 5,038,429 (virtually identical to EP 0,378,469) describes, furthermore, a tubular body subdivided into "compartments", in a hollow profile spar, on which individual pistons rest by means of rectangular supports over the entire tube width (see FIG. 4 and column 6, claim 1, line 15f and 19f). The subdivision into "compartments", in association with overflow ducts or diaphragms, is necessary for technically effective functioning in terms of stroke and damping.

(e) EP 0,489,374 describes a latticework, in which tube-like chambers receive an inflatable concertina which bears fully against them and on which the supporting shanks of the crosslaths rest in a sprung manner. According to the invention, the concertina has to be gas-filled taut.

The following are primarily to be listed as constructive feature differences between these latticeworks in (c) to (e) and the surface bearing.

In (c), all the cross laths are laid on directly over a wide area on the tubular body and are fixed in welded-on pockets.

In (d), a pressure element rests by means of a rectangular support over the entire tube width, with a piston rod as a connection to the crosslath, and the tubular body is subdivided into chambers.

In (e), a taut-filled concertina bears against the entire tube chamber wall.

As a consequence of construction, the following functional features emerge for latticeworks (c) to (e):

common to all of them is a rapidly commencing, continuously highly progressive stroke/force relation, the rigidity of which becomes the greater, the more laths are pressure-loaded;

in all of them (with the possible exception of (e)), the displacement of the laths brings about a flattening of the tube transversely to the stroke movement and, in the case of a wall having extension elasticity, an increase in volume of the tubular body;

all without chambers (hence with the exception of (d)) have major damping problems, especially in the case of a gas charge, but also in the case of incompressible filling media of relatively high viscosity, on account of the tube cross sections which scarcely decrease at all. They must reach a compromise between a flaccid bearing behavior and relatively large stroke displacements at low internal pressure or a hard bearing behavior and small stroke travels at high internal pressure;

the technically and functionally attainable stroke travel of a plurality of crosslaths simultaneously is therefore restricted approximately to half the tube height;

none of the systems has an appreciable positive stroke travel.

SUMMARY OF THE INVENTION

The object of the invention is to achieve by the simplest possible constructive means the functional properties which are listed in points I, I', II and III.

I. The rough contour adaptation is based on the pronounced special change in shape of the container:

inward-directed overturning in the negative stroke direction, to form two longitudinal chambers parallel to the axis of the container, and arching of the container in the positive stroke direction up to pressure equalization in the container medium.

I'. The inherent damping increasing progressively with the stroke takes place as a result of the sharp narrowing in cross section during the formation of the longitudinal chambers.

II. The sprung mounting especially in and after the final phase of rough contour adaptation is based on the change in volume of the container, the wall of which is advantageously selected from a material having extension elasticity, and/or is brought about by the introduction and compression of a delimited small gas volume.

III. The large stroke displacement, possible both negatively and positively, results from I and II and can be further increased by means of intrinsically sprung bearing elements.

The functional properties described in points I, I', II and III are achieved by means of the constructive features which are specified in claims 1) to 4) and 6).

On I: the change in shape of the tube-like container filled non-taut with an advantageously glycerine-like to gelatine-like incompressible medium occurs as a result of small-area bearing elements, of which the width b≈⅙ B to ½ B of the tube width B and of which the length 1≈b to 3b. The container height is H≈1 B to 3 B.

For the rough contour adaptation, despite the pronounced change in shape, only insignificant, scarcely progressive pressure forces and low work expenditure are necessary. The overturning occurs as a result of the squeezing of the tube wall. In the case of an advantageously low rigidity of the wall having extension elasticity, the squeezing work, virtually constant throughout the overturning process, is negligible; the same applies to the medium transport work during slow adaptation processes, since this is proportional to the square of the flow velocity. The extension work for elongating the wall on the container surface in the V-shaped overturning is critical for h>H only in the final phase of contour adaptation and is highly material-dependent. The work $W_A$ to be taken into account must be executed by means of the change in mass (height) distribution, the transport of the container medium (advantageously water with a gelling agent) out of the overturning into the arching counter to the force of gravity.

$$W_A=\Delta mg\cdot\Delta h\approx 7.5\cdot 10^{-2} J \text{ per bearing element,}$$

under the experimental conditions: height change Δh=½ B 5 cm, transported mass Δm<200 g=2 dl $H_2O$ and gravitational acceleration g≈10 m/s$^2$.

From the slightly progressive increase in the stroke force to h=0.6 H, the upper limit of the extension work during the overturning can be estimated at a maximum of $W_A$.

In the bed underframe surface bearing according to FIG. 2, a human body having a mass of approximately 80 kg can, when in a position on its side, press down approximately 10 bearing elements by approximately 0.6 H and a further 6 bearing elements by approximately 0.3 H (altogether 2×14=28 for the two side spars of the bed underframe). The potential energy lost to the body on average is $$W_k=mgh=80\ kg\cdot 10\ m/s^2\cdot 0.05\ m=40\ J$$

In this equation, 16 moved bearing elements have two $W_A$ each (work counter to the force of gravity and for longitudinal extension), hence altogether 32 $W_A$. It emerges from the ratio 32 $W_A/W_K$<0.05 that only around 5% of the potential gravitational energy has to be expended for pure rough contour adaptation.

The remaining 95% is absorbed by the elastic component of the change in volume, that is to say by the elastic expansion of the container wall, which takes place highly uniformly because the pressure is the same everywhere, and leads to the sprung support of the body.

Despite the low pressure force required and the coarse stroke adaptation work, the coupling of all the bearing elements takes place mainly as a result of the overturning and arching processes which also ensure the positive sustainment of relatively deep recesses and the highly uniform support of the lying body, said support being free of pressure peaks.

The mass of the liquid medium can perfectly well be lower by more than one order of magnitude than that of the body to be supported, with the result that the total weight of the surface bearing is kept within limits.

On I': Inherent progressive damping occurs by virtue of the double longitudinal chamber design due to the overturning of the tube, at the same time with a reduction of the tube height H to approximately half.

The effective cross-sectional radius is in this case, for B=H/2, reduced from $r_1$=(B+H)/4=3H/8 to $r_2$<(H/2+B/3)/4=H/6, see FIG. 1.

According to Hagen-Poiseuille's law, the liquid volume ΔV flowing through per unit time At is proportional to the orifice radius $R^4$ and universally proportional to the viscosity η of the medium.

$$\Delta V/\Delta t\sim R^4/\eta$$

Consequently, in the case of pronounced overturning, the liquid volume forced through $\Delta V_2 \leqq \Delta V_1/25$ is reduced by approximately the factor 25.

Water with a gelling agent, which results in less temperature-dependent viscosity η≈2Ns/m$^2$ (approximately equal to that of glycerine and T=15° C.), is advantageously used as a filling medium.

With this filling of a rubber tube (B=H/2≈4 to 5 cm, wall thickness 1.4 mm, motor cycle tube quality) in each of the two side spars of a 200 cm×100 cm underframe (according to FIG. 2 or 3), no oscillations, no throw-out effect during climbing in and nevertheless a pleasantly smooth adaptation when the human body changes from a position on its back to one on its side are observed. The time constant of the damping and the optimum adaptation to the bodyweight can be determined by the choice of viscosity of the filling medium and by an increase in the filling pressure $p_0$ for the non-loaded container.

For adaptation to the mass distribution of the human body, the bearing element area can also be varied. The behavior described in points I and I' and the properties according to the invention of the tubular container were obtained in many tests with different containers and bearing elements in a test setup, one side wall of which was made of Plexiglas for observation purposes. Complex multichamber or multitube systems could thereby be reduced to the simple overturning single-tube system, self-damping precisely in the case of small-area bearing elements and having a gelatine-like, incompressible charge.

On II. Change in volume of the container 1 For elastically sprung support, the wall of the container is advantageously selected from a material having extension elasticity and/or a relatively small part of the container volume, for example in the foot region of the underframe, is filled with a separate gas buffer volume. The two measures introduce an elastic component, that is to say a progressive stroke/pressure-force relation, especially in the final phase of the adaptive displacement of the bearing elements.

With and without this elastic component, the same pressure is established in the state of equilibrium everywhere in the container. This results, even in the case of small-area bearing elements, in a uniform tensile load on the container wall, said tensile load being distributed and therefore low at the various points; this also applies to the overturning region for bearing elements having rounded corners and edges and the above-mentioned dimension limits.

The stroke $h_{e1}$ caused by the elastic change in volume is markedly smaller $h_{e1} \approx h/5$ to $h/10$ than the stroke of change in shape h.

The elastic stroke component $h_{e1}$ can advantageously be increased to $h_{e1} \approx h/3$ to $h/2$ by designing the bearing elements as telescopic spring rods (see FIG. 3) or as oval double trapezoidal or annular spring elements (see FIGS. 2*a* and *b*) arranged in the longitudinal direction of the tube.

On III. The total stroke displacement caused by the changing shape of h>H, the non-loaded container height, can be increased to $h_{tot} = h + h_{e1} \approx 4H/3$ to $3H/2$ by means of the additional elastic elements, the total constructional height $H_{tot}$ of the underframe then being $H_{tot} > 10H/6$ to $7H/3$ (FIG. 2).

In use as the underframe of a bed, couch or armchair, there are in addition to the underframe stroke:

- the elastic deflection, for example of the double transverse battens, which each connect a bearing element in the two side spars of the frame (see FIG. 3), and
- the volume elasticity of the frame support, the height of which can be selected preferably approximately ⅓ $H_{tot}$ smaller than normal mattresses. The support must also be designed in such a way that it accommodates and does not impede the large possible frame stroke.

By virtue of the constructive measures taken, the pneumatic sprung surface bearing comes very close to ideal lying and sleeping comfort. This is achieved as an average of the suspended or floating state of a body in a liquid, for example seawater, with the bearing pressure being the same everywhere and in the state in which the sustaining pressure forces correspond everywhere to the mass distribution. Precisely this middle course is followed in the surface bearing by virtue of the coarse stroke adaptation, which builds up little sustaining pressure, and the final, mass-dependent sprung support, the bearing pressure of which is, however, averaged out by setting a mean pressure in the container medium.

The pneumatic sprung surface bearing offers lying/sleeping comfort similar to that of the water bed, without having the disadvantages of the latter:

- Adaptability restricted by the density and toughness of the envelope
- Restriction of movement in the event of a change in the lying position as a result of lateral pressure forces in the sink-in depression and of the water displacement necessary for this, especially high in chamber systems
- Water bag envelope fully impermeable to water and vapor
- Tendency to sloshing, high weight and heating/temperature regulation necessary.

BRIEF DESCRIPTION OF THE DRAWINGS

The pictures in FIG. 1 to FIG. 4 illustrate the most important parts and functions of the invention, especially for the main use, the pneumatic sprung bed underframe. They show the basic structure diagrammatically and in each case represent only one of several possible designs and uses.

DETAILED DESCRIPTION OF THE PREFERRED EMBODIMENT

Figure 1:
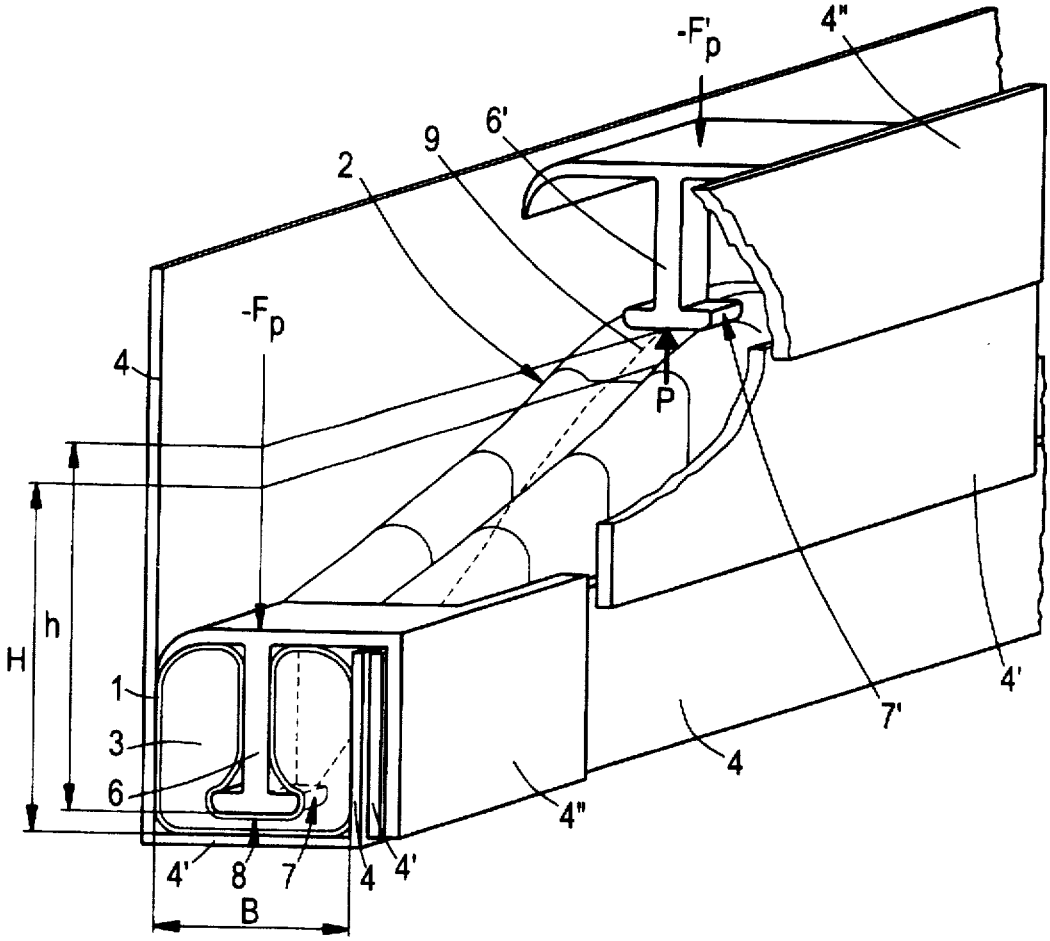
FIG. 1: A diagrammatic detail of a pneumatic sprung surface bearing consisting of a tube-like container 1 which is variable in shape and advantageously also in volume and which is shown in the two extreme variations in shape of negative overturning 8 and of positive arching 9.

FIG. 1 shows, as a detail, a pneumatic sprung surface bearing with a tube-like container 1 of variable shape, which is filled non-taut with an incompressible medium 3 and is located in the U-shaped support member 4 with asymmetric legs and which has movable side walls 4' and 4" which are advantageously guided in grooves or rails (not shown). Via the preferably anchor-shaped bearing elements 6, 6' which are connected to the upper side walls 4", the bearing pressure forces $-F_p$ and $-F_p$ are exerted on the container 1. They can lead to the two pronounced special deformations of the container 1 which are shown, namely the overturning 8 in the negative stroke direction and the positive arching 9 above the equilibrium height H of the non-loaded container, up to the setting of a pressure p everywhere the same in the medium 3. By means of the side walls 4' and 4" overlapping each other and overlapping the short inner leg of the U-shaped support member 4, the entire stroke h>H can be utilized for coarse contour adaptation to a lying body.

The bearing elements 6, 6' are advantageously designed in the form of a T or of an anchor and then result in an optimum design and form of the overturning 8 with:

low load on the container wall 2, favorable accommodation of the cross-sectional wall perimeter, which scarcely varies as a result of the overturning, along with a minimum remaining height of the container 1, the formation of 2 separate longitudinal chambers for progressive damping, and automatic buffering sit-on stops as a result of the resting of the anchor top part on the overturned container.

Furthermore, the bent narrowing front part of the upper anchor plate, said front part preferably consisting of elastic material and bearing on the outer leg of the U-support member 4, can absorb and equalize relatively small horizontal displacements of the side walls 4".

Figure 2A:
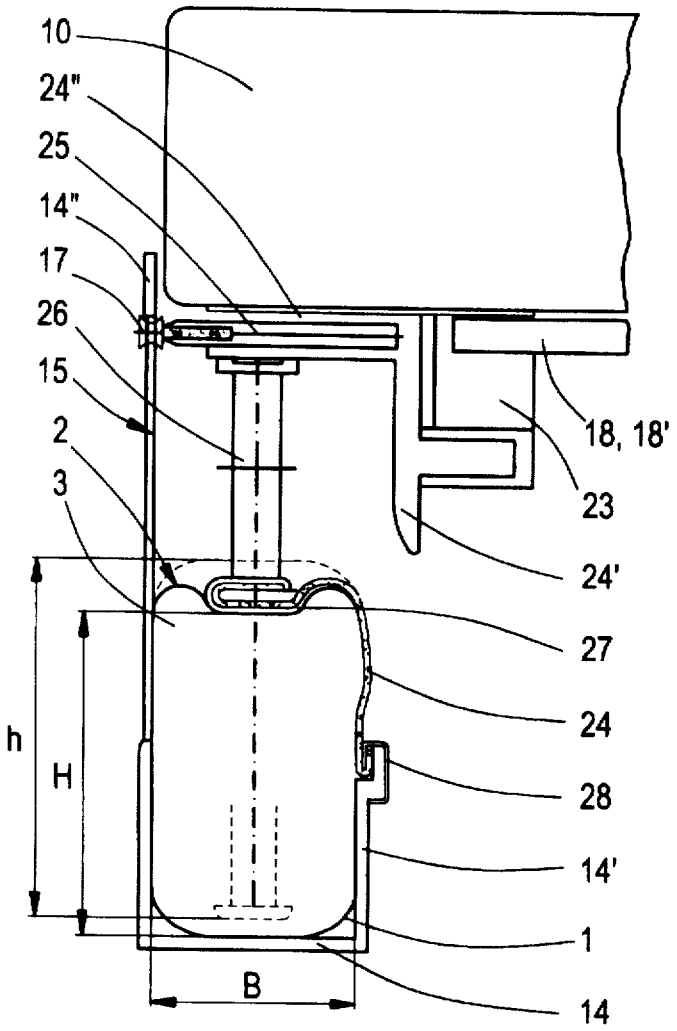
FIG. 2*a*) A cross section through a side part structure of a pneumatic sprung bed underframe surface bearing with a side support member 4 in the form of an asymmetric U-profile and with a flexible middle side wall 24 for receiving the tubular container 1, with FIG. 2*b*) bearing elements 26 designed as an annular spring, for increasing the elastic stroke travel by $h'_{e1}$, and a mattress support 10.
Figure 2B:
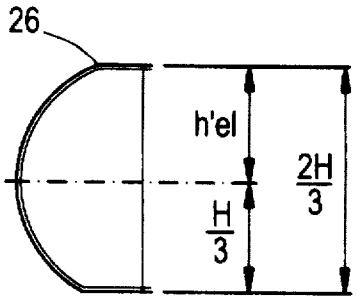

FIG. 2 shows, as a cross section, the technically functional side part structure of a bed underframe with a mattress support 10 on the basis of the pneumatic sprung surface bearing. An asymmetric U-profile support member 4 surrounds the container 1 of width B≈H/2 over ⅔ of its cross-sectional perimeter. The container wall part extending over the short inner leg 14 of the U-shaped support member 4 is contained by a flexible thin side wall 24 and is essentially prevented from bulging out into the bed frame interspace transversely to the stroke displacement h. For this purpose, the flexible side wall 24, having extension elasticity preferably in the longitudinal direction of the support member 4, is fastened, for example in each case by means of a simple clip device 28 and 27, respectively to the short inner leg 14 and to the lower part of the bearing element 26, around which inner leg and which lower part it is advantageously additionally looped. The flexible side wall 24 can consist of a single rubber band over the side support member lengths of, for example, 200 cm, with a wall thickness of approximately 1 to 2 mm. Since a rubber band subjected to tensile stress in the longitudinal direction exhibits transverse contraction, it then opposes extension to a greater extent transversely to the tensile direction.

The upper movable side wall 24' is connected to the bearing element 26 and to a cap 23 made from commercially available soft plastic material, for example for the reception of double crosslaths 18, 18' composed of spring wood battens, on which the mattress support 10 lies. The movable upper side wall 24' having the crosslaths 18, 18' are [sic] guided vertically by a groove 15 in the long outer U-leg 14", in which groove runs a roller 17, the axle 25 of which is set displaceably in the horizontal upper part 24" of the side wall 24' and thus equalizes the inclination-related and deflection-related change in spacing of the crosslaths. To increase the elastic stroke travel, the bearing elements are designed as annular springs 26, the elastic stroke of which amounts, in the example given, to $h_{el}$=H/3, with an annulus height of 2 H/3.

When pressure is exerted by a body lying down on the bed, the movable side wall 24' can be lowered past the flexible wall 24, the container 1 being overturned as far as the base of the U-shaped support member 4. The flexible side wall 24 accompanies the overturning process and equalizes height differences relative to the adjacent bearing elements by longitudinal extension. Under an especially high load, an additional flexible non-extendible reinforcing band, for example made of fabric, with a width of B/2 to B, fastened to the support member leg 14 and the annular spring 26, can be attached so as to be tensioned via the side wall 24 having extension elasticity.

The flexible side wall 24 can also consist of individual longitudinal lamellae as a continuation of the support member side wall 14, without any connection to the bearing elements 26, which longitudinal lamellae can be folded round towards the container 1, but, by means of a stop, oppose the arching into the support member interspace. This lamellar side wall must be segmented at the spacing of the double crosslaths.

The total stroke of the surface bearing represented in FIG. 2 is $h_{tot}$=h+$h'_{el}$>4H/3. The total constructional height of the bed, including a support having a height of 2 H/3, is then $H'_{tot}$=7H/3=24 cm, for example for a container height H=10 cm. This constructional height can be compared perfectly well with the total height of a conventional underframe with mattress. The pure surface bearing stroke $h_{tot}$≈14 cm consequently attains almost 60% of the bed height including the mattress support, without including the deflection of the crosslaths 18, 18' or the recess having volume elasticity in the support 10, said deflection and said recess contributing a further stroke fraction of 4 to 6 cm.

Figure 3:
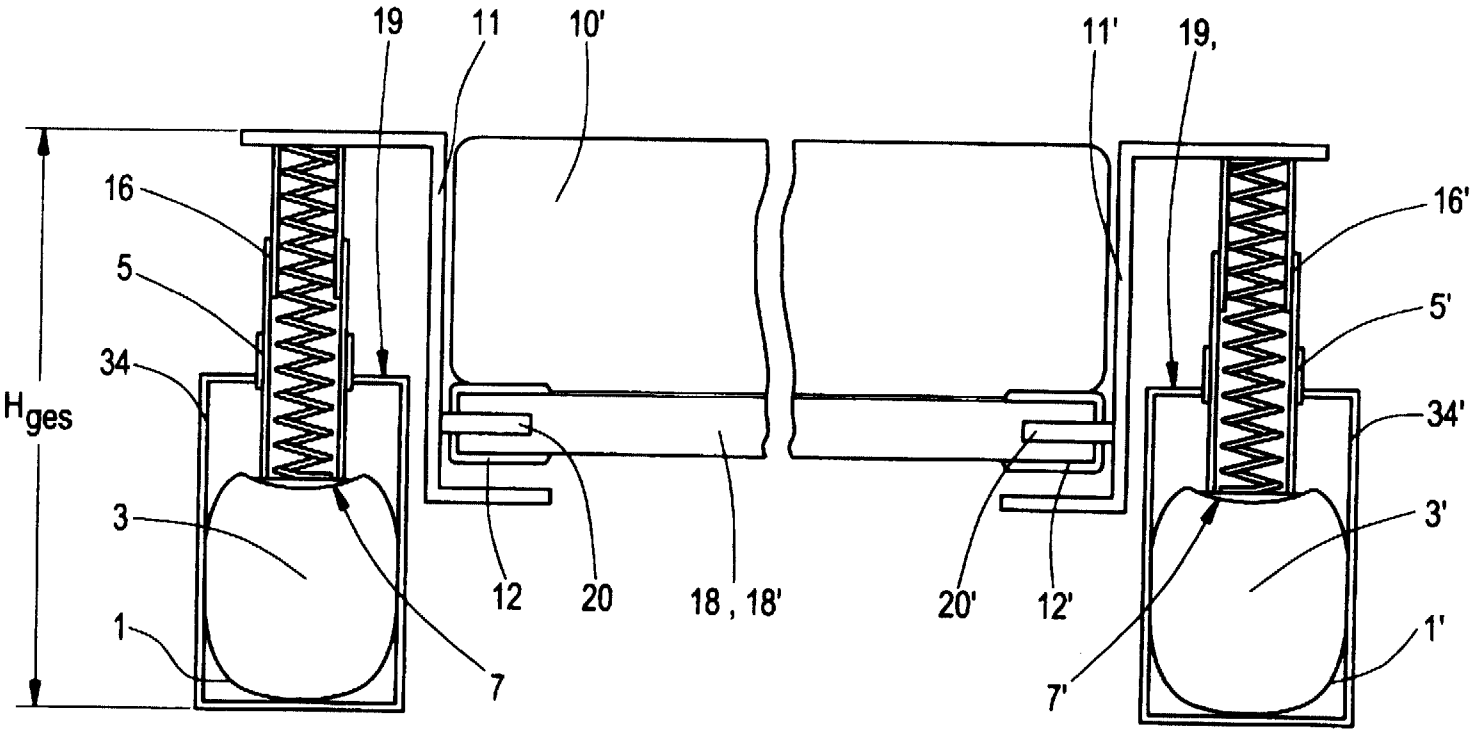
FIG. 3: A cross section through a pneumatic sprung underframe for bed, couch or armchair, having a small constructional height $H_{tot}$, with two separate tube-like containers 1 and 1' in the two square-profile side support members 34 and 34' and with a lowered inner mattress support 10'.

FIG. 3 shows a cross section through a further technically functional example of a solution for a bed surface bearing underframe with a lowered inner mattress support 10'. The two square-profile side support members 34 and 34' each receive a tubular container 1 and 1'. The bearing elements 16, 16', connected in pairs preferably by means of double crosslaths 18, 18', are designed, in order to increase the elastic stroke travel $h_{el}$, especially in the critical shoulder and buttock regions of the underframe, as telescopic spring rods which are guided in bushings 5, 5' in the top parts 19, 19' of the support members. The telescopic spring rods 16, 16' are connected to the crosslaths 18, 18' via Z-shaped angle elements 11, 11', with the result that the mattress 10' can be lowered into the support member interspace. A high ratio of total stroke to total bed height of $h_{tot}/H_{tot}$≈½ is thereby achieved once again. The crosslath receptacles 12, 12' are rotatable about their axes 20, 20'.

Figure 4:
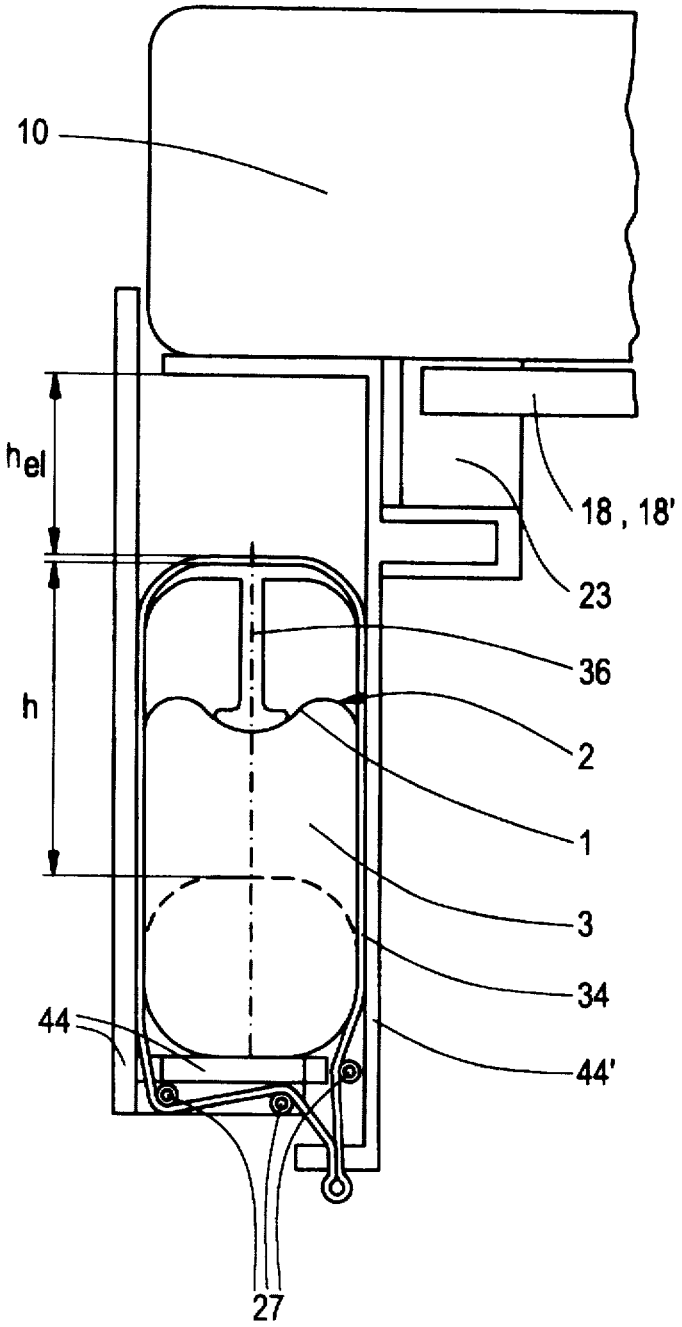
FIG. 4: A cross section through a pneumatic sprung bed underframe, with a stationary L-profile side support member 44 and with a downwardly lowerable inner wall 44' which, in association with an elastic rubber band 34, brings about the deformation of the tubular container 1 via an anchor-shaped bearing element 36.

FIG. 4 represents, in cross section, a bed underframe with an L-shaped stationary support member 44 and with a conversely L-shaped inner wall 44' lowerable downward. The pressure load is transmitted via the support 10, the crosslaths 18, 18' and the inner wall 44' to an elastic band 34 around the anchor-shaped bearing element 36 to the tubular container 1. The band having the width B/2 to 3 B/2 runs past the side wall of the container 1 and is fastened to the lower part of the side wall 44. Rollers 27 can be used for guiding and deflecting the band. The deflection of the band for fastening to the inner wall is advantageous, so that the outer part of the support member base can be laid on the side cheek stays of the bedstead. In this version, the additional elastic stroke fraction $h'_{el}$ is supplied by the elastic band, for example made of rubber.

During the overturning and lowering process, the container wall 2 partially rolls and partially slides on the side wall 44'. Sliding can be promoted by the choice of the side wall (surface) material and/or assisted, for example, by talcum. The remaining static friction constitutes a further damping factor.

All the described examples of the pneumatic sprung underframe with support can be used in any conventional bedstead. Since these usually have sufficient floor clearance, deflection of the crosslaths 18, 18' and of the mattress support 10 below the side support member lower edge, in the example of FIG. 4 also the lowering of the inner side wall 44', are possible, as in conventional versions.

An angular adjustment of the head part and leg part of the pneumatic underframe by at least +30° and +10° respectively is possible. In the pneumatic sprung underframes described, even in combination with additional sprung elements (telescopic spring rods, elastic crosslaths and mattresses), virtually no lateral forces impeding freedom of movement occur. The use of two separate symmetrical tubular containers 1, 1' in the two side support members of the underframe results in a uniform load reaction and avoids the throwout effect when a person climbs into a bed or the bed is loaded on one side. The number of bearing elements 6, 6', etc., in each case connected to double crosslaths, is advantageously 14, arranged at intervals of 14 cm on a bed support member of 200 cm. Arrangements other than those described by way of example and combinations with known or modified undermattress elements and mattress supports are, of course, likewise possible. The extremely high contour adaptability according to the invention, along with highly uniform bearing pressure distribution without pressure peaks, was checked and verified on three different prototypes by means of the Ergocheck® pressure mattress computer system in many tests in the shoulder and buttock region, also in the position in which a person is lying on his side.

In all the versions described, adaptation to the weight of the lying body and to the stress can be carried out selectively by means of one or more of the following constructive and functional measures:

- choice of the viscosity of the incompressible filling medium 3
- adaptation of the bearing surfaces 7, 7' to the total weight and/or to the mass distribution of the body
- continuous variation of the container filling pressure by pressing a large-area ram plate having the area $A \approx B^2$ to $5\ B^2$ against the underside of the container 1, or
- the introduction of a separate gas volume by means of a spatially delimited gas cushion; both are preferably located in the foot part region of the underframe.

In addition to the use as a bed undermattress, the pneumatic sprung surface bearing described can also be employed for couches and armchair upholstery, for example for people confined to bed for some time, those with a slipped disc and paraplegics, and as a contour-adaptable surface bearing in (large animal) veterinary medicine. Further illustrative examples of the possibilities for use of the pneumatic sprung surface bearing are:

surface bearings for buildings or building parts in districts where there is a high risk of earthquakes surface bearings for the transport of highly sensitive goods or equipment, sprung tilt-sensitive surface bearings in automobile and railroad construction, vibration decoupling surface bearings for vibration-sensitive appliances, lasers, instruments or demonstration desks.

What is claimed is:

1. A hydrodynamic sprung surface bearing comprising:

a tube-shaped container;

at least two side walls against which the container partially bears and which allow deformation of the container in a single outward direction; and at least two bearing elements abutting the container, each bearing element having a bearing surface pressing against a surface of the container, the bearing surfaces being smaller, in total, than the surface of the container, wherein the container is filled with a substantially incompressible medium; and wherein, upon application of a force to the container by a bearing element, the bearing element causes a change in a shape of the container, including positive arching of the surface of the container; and wherein a portion of each side wall bears against the container, and at least one side wall comprises a flexible member allowing a change of shape of the container, including positive arching of the surface of the container.

2. A hydrodynamic sprung surface bearing as claimed in claim 1, wherein the bearing surfaces are one order of magnitude smaller, in total, than the surface of the container.

3. A hydrodynamic sprung surface bearing as claimed in claim 1, wherein the container comprises a material having extension elasticity.

4. A hydrodynamic sprung surface bearing as claimed in claim 1, wherein the substantially incompressible medium comprises a liquid and additives causing the liquid to gel to a predetermined viscosity.

5. A hydrodynamic sprung surface bearing as claimed in claim 1, wherein the bearing elements are generally T-shaped.

6. A hydrodynamic sprung surface bearing as claimed in claim 1, wherein the bearing elements are generally anchor-shaped.

7. A hydrodynamic sprung surface bearing as claimed in claim 1, wherein the bearing elements comprise an elastic material.

8. A hydrodynamic sprung surface bearing as claimed in claim 1, wherein the at least two side walls are displaceable and are guided in grooves along a direction of application of force by the bearing elements, and the side walls can overlap one another.

9. A hydrodynamic sprung surface bearing as claimed in claim 1, further comprising an elastic band surrounding the container and fastened to a lower portion of a side wall bearing against the container, the elastic band causing positive arching of the surface of the container upon application of a force to the container by movement of the side wall.

10. A hydrodynamic sprung surface bearing for an underframe of a bed, comprising:

at least two elongate side support members, each side support member having a tube-shaped container therein;

at least two bearing elements abutting each tube-shaped container, each bearing element having a bearing surface pressing against a surface of a respective container;

at least two crosslaths supported by the containers and spaced along a length of the containers at predetermined intervals; and Z-shaped angle elements which connect the crosslaths to the bearing elements, wherein the containers are filled with a substantially incompressible medium; and wherein, upon application of a force to the containers by a bearing element, the bearing element causes a change in a shape of the containers, including positive arching of the surface of the containers.

11. A hydrodynamic sprung surface bearing as claimed in claim 10, wherein a cross-section of each elongate side support member is generally U-shaped.

12. A hydrodynamic sprung surface bearing as claimed in claim 11, wherein a cross-section of each elongate side support member is generally L-shaped.

* * * * *

UNITED STATES PATENT AND TRADEMARK OFFICE

CERTIFICATE OF CORRECTION

PATENT NO. : 5,784,731
DATED : July 28, 1998
INVENTOR(S) : Weber

It is certified that error appears in the above-identified patent and that said Letters Patent is hereby corrected as shown below:

Column 6, line 32, delete "Figure 2: a)" and insert -- Figure 2 (a) --

Column 6, line 37, delete "b)" and insert -- Figure 2 (b) --.

Column 7, line 25, delete "Figure 2 shows, as a cross section," and insert -- Figures 2 (a) and 2 (b) show, as cross sections, --

Signed and Sealed this

Sixteenth Day of February, 1999

*Attest:*

*Acting Commissioner of Patents and Trademarks*

*Attesting Officer*